United States Patent [19]

Anthony

[11] Patent Number: 4,490,213

[45] Date of Patent: Dec. 25, 1984

[54] COAL CONVERSION PROCESSES

[75] Inventor: Myron L. Anthony, Grand Junction, Colo.

[73] Assignee: EPIC Research Corporation, Denver, Colo.

[21] Appl. No.: 487,262

[22] Filed: Apr. 21, 1983

Related U.S. Application Data

[63] Continuation-in-part of Ser. No. 331,138, Dec. 16, 1981, abandoned.

[51] Int. Cl.[3] ..... C10B 55/06; C10L 9/04; C10L 9/08

[52] U.S. Cl. ..... 201/17; 44/1 B; 44/1 F; 201/29; 201/30; 208/8 LE

[58] Field of Search ..... 201/3, 17, 41, 44, 13, 201/14, 21, 23, 28, 29, 32, 45; 44/1 B, 1 C, 1 F, 51; 208/8 LE; 202/118

[56] References Cited

U.S. PATENT DOCUMENTS

| | | | |
|---|---|---|---|
| 1,573,764 | 2/1926 | Forrest | 201/44 |
| 1,938,596 | 12/1933 | Karrick | 202/118 |
| 2,947,670 | 8/1960 | Hobson | 201/34 |
| 3,359,040 | 12/1967 | Every et al. | 44/51 |
| 3,637,464 | 1/1972 | Walsh et al. | 201/44 |
| 3,658,654 | 4/1972 | Gutberlet | 202/118 |
| 3,791,994 | 2/1974 | Wenzel et al. | 201/44 |
| 3,836,435 | 9/1974 | Skornyakov et al. | 201/44 |
| 3,841,991 | 10/1974 | Cohen et al. | 201/23 |
| 3,970,541 | 7/1976 | Williams et al. | 201/44 |
| 4,095,954 | 6/1978 | Kinal | 44/1 B |
| 4,095,955 | 6/1978 | Stambaugh et al. | 44/1 C |
| 4,127,391 | 11/1978 | Koppelman | 44/51 |
| 4,130,474 | 12/1978 | Anthony | 71/61 |
| 4,139,416 | 2/1979 | Palumbo et al. | 201/44 |
| 4,145,189 | 3/1979 | Solbakken | 44/51 |
| 4,208,251 | 6/1980 | Rasmussen | 201/32 |
| 4,263,013 | 4/1981 | Smith | 44/1 B |
| 4,294,664 | 10/1981 | Anthony | 203/24 |
| 4,385,980 | 5/1983 | Sooter | 208/8 LE |
| 4,406,744 | 9/1983 | Berg | 201/44 |

FOREIGN PATENT DOCUMENTS

| | | | |
|---|---|---|---|
| 0076493 | 6/1981 | Japan | 44/1 C |

*Primary Examiner*—Bradley Garris

*Attorney, Agent, or Firm*—Kinzer, Plyer, Dorn & McEachran

[57] ABSTRACT

Coal is processed sequentially over a range of temperatures up to a maximum of 750° F. and preferably considerably less to obtain a clean burning coke, refinable petroleum and bitumen products, fertilizer minerals, combustible gases and water; the process is capable of producing a highly porous, easily crushed coke substantially free of pollutants and almost entirely depleted of oil so that it is hygroscopic and easily transformed to a pipeline slurry. The process is not one of destructive distillation but neither is atmospheric air employed as a combustion oxidant or reactant in the system; the process is preferably conducted under reflux conditions in a closed vessel and in such a way that the heat input is complemental substantially to the thermo-absorption spectrum of the coal.

7 Claims, 13 Drawing Figures

Fig. 5A.
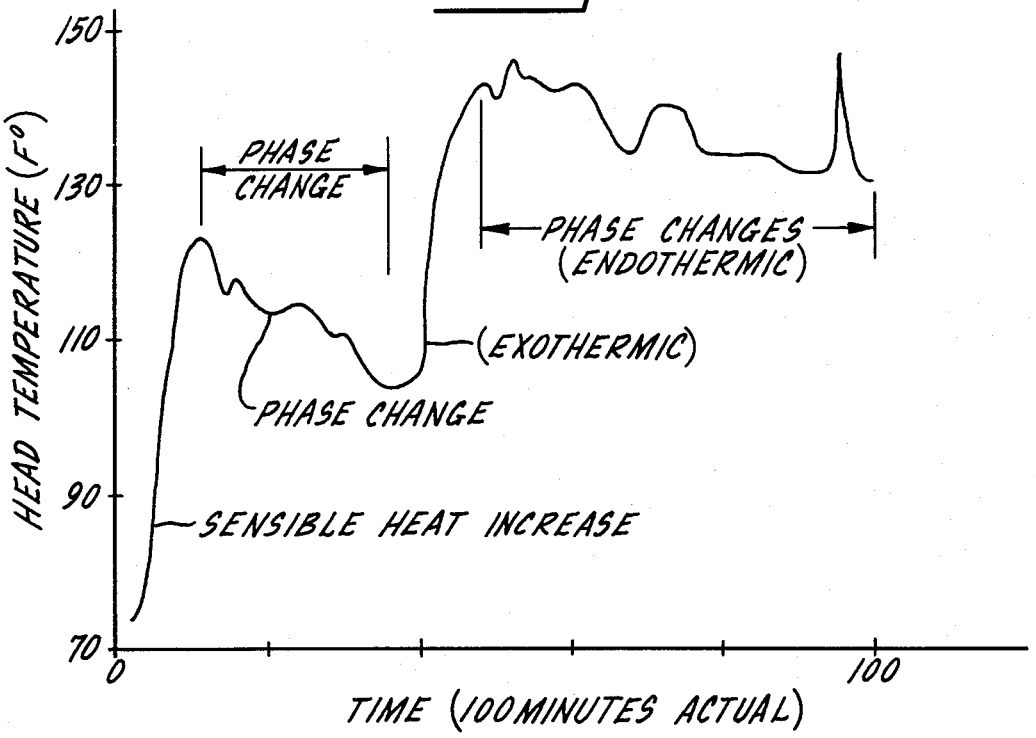
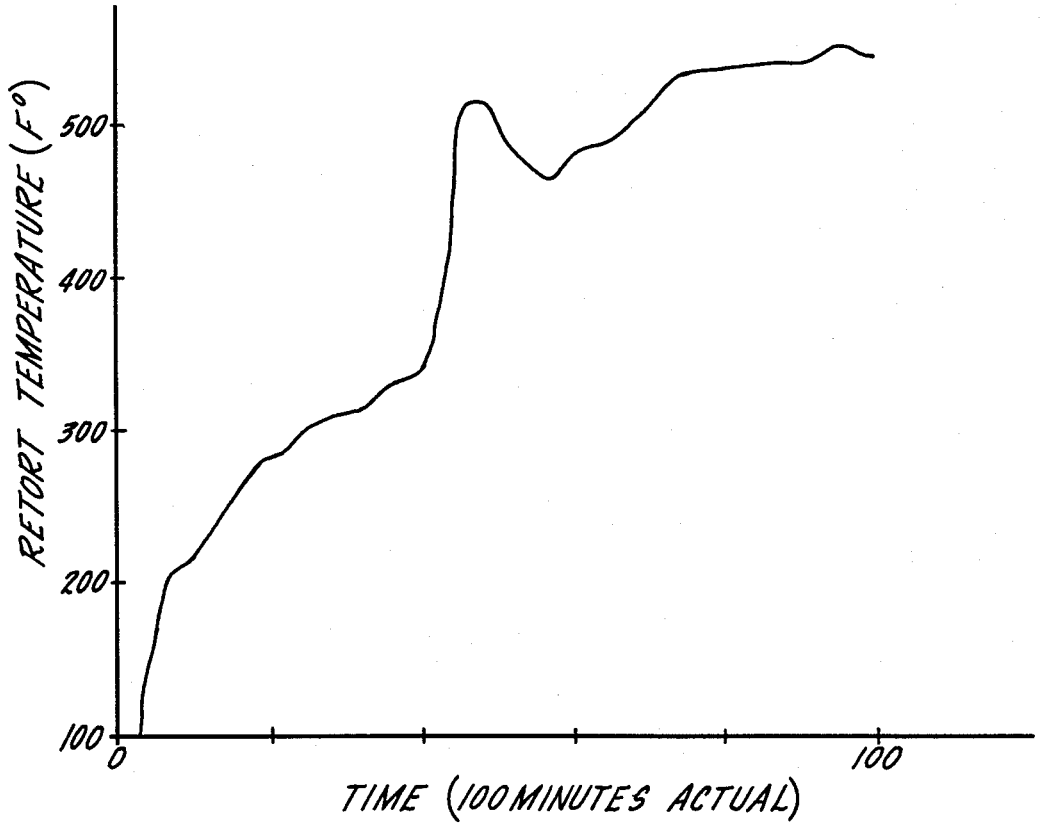
Fig. 5B.

GAS (+) – METHANE PLUS OTHER GASES
$H_2O$ (+) – WATER SOLUBLE MINERALS
$H_2O$ – WATER VAPOR
LIGHT – LIGHT PETROLEUM FRACTIONS
HEAVY – HEAVY PETROLEUM FRACTIONS
CHAR – RESIDUE CHARCOAL

COAL CONVERSION PROCESSES

REFERENCE TO RELATED APPLICATION

This application is a continuation-in-part of application, Ser. No. 331,138, filed Dec. 16, 1981, now abandoned.

INTRODUCTORY DESCRIPTION

Coal is processed by means of subpyrolytic roasting, by distillation, by solvent extraction and by a water leach. Process product yields, in order of recovered weight percentage, include coke, water, heavy liquid petroleum, methane and other fixed gas, and soluble inorganic salts, notably nitrates, phosphates and potash. Lignites of a quality worthy of processing are deemed equivalent to coal.

The process is based on the selective removal of various coal constituents in sequence; successive substrates within the coal particle are uncovered or made susceptible to subsequent extracting means. These steps also result in the progressive delamination and exfoliation of internal coal substrates which, by means of internal vapor rupture and progressive surface exposure (i.e. surface-volume ratio), greatly enhance the reaction speed and extraction efficiency.

The residue comprises a high carbon, high purity coke or carbon product, free of inorganic intrusion and pyrolytic reaction products derived from the host carbon substrate, the petroleum bitumens and the entrained inorganic minerals.

Process temperatures vary with successive steps but at all times are less than 750° F. and usually at atmospheric pressure, although there are stages where a pressure up to two atmospheres could be advantageously imposed. Feed stock coal weight loss varies and may be as much as one-third, depending on the particular coal type as shown by the following table:

energy needs of many nations. While oil is still immensely valuable in this country, production is about one-half our current requirements. New discoveries are being made but fail to balance the depletion of existing production.

In the United States the shortfall of oil is made up by import from foreign sources. Unfortunately these sources are politically influenced and sometimes inexpertly utilized so that a continuation of vital foreign supplies cannot be assumed.

The known and readily realizable coal reserve in terms of total energy within these United States of America is literally hundreds of times greater than our possible petroleum prospects and are probably sufficient for at least several hundreds of years, even at an accelerated rate of consumption.

Plentiful coal can and will, in time, substitute for scarce and costly oil. It has been done before. Under the duress of World War II the armed forces of Germany were fueled entirely by coal-derived products. Also, the Republic of South Africa is currently, and has been for some time, involved in extensive development of coal derived fuel and related bituminous products.

A major cost factor in the use of coal as an energy source, whether consumer, electric or industrial production, is related to transportation. Currently a considerable amount of coal is being transported from the west (Wyoming, Colorado, etc.) to the near east (Ohio, etc.) and the east coast. In such cases transportation costs equal or exceed the mine source cost of the coal and considerable fuel energy (currently, oil) is expended in the process.

Despite the heavy burden of transportation costs, coal in large amounts is being carried from west to east. Coal is plentiful in the East yet under the present circumstances cannot readily be used. Uncontrolled burning of vast amounts of high sulphur and nitrogen coal presents such an environmental hazard that stern and PROCEED YIELD as to VARIOUS RANK

| Mine & Rank | Water % | Water lb/ton | Oil % | Oil lb/ton | Soluble Inorganic Mineral % | Soluble Inorganic Mineral lb/ton | Gas ft.$^3$/ton | Gas Stripper Recovery % | Gas Stripper Recovery lb/ton | Residue % | Residue lb/ton |
|---|---|---|---|---|---|---|---|---|---|---|---|
| 1. Cameo-Reject-(B) | 7.38 | 147.6 | 2.17 | 43.4 | .14 | 2.8 | 1359.3 | n/a | n/a | 87.87 | 1757.4 |
| 2. Dorchester-Reject-(B) | 17.8 | 356.0 | 2.38 | 47.6 | .31 | 6.2 | 1737.5 | .61 | 12.2 | 75.32 | 1506.2 |
| 3. Monnig #3-(B) | 17.48 | 349.6 | 11.34 | 226.8 | N/A | N/A | 1795.5 | 1.6 | 21.2 | 66.31 | 1326.2 |
| 4. North America-(L) | 39.86 | 797.13 | 1.86 | 37.2 | .15 | 3.0 | 3835.5 | 2.21 | 44.2 | 47.66 | 963.2 |
| 5. Strauss-Reject-(B) | 17.9 | 358.0 | 3.38 | 67.6 | N/A | N/A | 1756.3 | .71 | 14.2 | 74.28 | 1485.6 |
| 6. West Virginia-(B) | 6.29 | 125.8 | 8.09 | 161.8 | .41 | 8.13 | 1149.79 | 6.48 | 129.6 | 76.27 | 1525.43 |

(B) Bituminous
(L) Lignite
Reject = Dross

The process is to be distinguished from destructive (dry) distillation of coal conducted either in the high temperature range (900°–1200° C.) or the low temperature range (500°–750° C.). These values are according to *Van Nostrand's Scientific Encyclopedia.*

BACKGROUND

Historically, and to varying degrees of intensity, coal has been an important worldwide economic and industrial energy source. The United States of America enjoys an extremely vast and vital heritage of energy resources in terms of both coal and oil.

Until the advent of widespread and plentiful production of liquid petroleum and natural gas, coal constituted the major source of power required to supply the highly restrictive pollution control measures are mandated. Such mandates place the cost of energy for such fuel beyond present economic realization.

The coal and coke residue resulting from the process described herein is essentially carbon with a pound for pound BTU yield equal to high quality raw or unconverted coal. Its BTU yield per pound is substantially greater than the unprocessed coal thus resulting in a substantial reduction in transport cost on a BTU basis. It is substantially reduced in major pollution generating agents and hence may be used as a mass energy source without prohibitive pollution control costs.

The pipeline transport of coal as a slurry is the subject of intense public debate. If employed, transportation costs would certainly be reduced and large supplies of energy would be conserved.

Various factions for various reasons oppose or support such a notion. An almost insurmountable problem arises out of the need for water as a coal slurry transport means. Coal in the western United States is plentiful but vital water is in short supply there and becoming more so with time. The coal slurry problem is not likely to be resolved under these circumstances.

This socio-economic discussion is included here within the operational outline of the coal process because of its direct bearing on the aspect of energy transportation costs. In a very real sense the widespread distribution of energy also relates directly to this consideration.

Rail transportation of coal is costly both in terms of dollars and oil derived fuel requirements. Pipeline slurry of coal, under the present state of the art, requires transport water utilization beyond reasonable means in many parts of this country as already noted, and in most instances the water would be going in the wrong direction.

On the contrary, coal, when processed as described herein, results not only in valuable petroleum, gas and fertilizer products, but even more importantly a light porous coke of near carbon residue which can be slurried in water derived from the process. This spongelike carbon residue is so soft it can easily be crushed to a fine powder between thumb and finger.

Coal as mined, on the other hand, is crushed or milled to a fine powder only at some substantial expenditure of energy. The milled coal can be mixed with water to form a pipeline slurry. The water cannot be reasonably returned to the source nor can the energy for milling be recovered. It is important to note that mine run coal, even pulverized, is virtually insoluble in water and is not readily wettable. This results in the requirements for considerable amounts of flotation water to form a pumpable pipeline slurry mix.

It is interesting to note that coal when processed as described here takes on a completely different character. The near pure and spongelike coke residue can be pulverized with ease. Being free of oily bitumens and entrained gases it is easily wettable, in fact being hygroscopic to a substantial degree for reasons to be explained. More importantly the water produced during the selective processing is more than enough to produce a highly satisfactory pipeline slurry and this excess water may be used to leach water soluble fertilizer constituents from the porous coke.

It is an object of this invention to obtain water from coal, such water being suitable for most ordinary use as well as in sufficient quantity to be combined with the processed coal as a slurry suitable for pipeline transport.

It is a further object of the invention to produce combustible gas from coal by nondestructive distillation or conversion means, such gas being suitable for on site boiler fuel, pipeline transport or conversion to alcohol.

A further object of the invention is to obtain petroleum type oils, waxes, tars or bitumens from coal in substantial quantities while preventing the pyrolizing of these substances or their reaction with inorganic host minerals, such products being suitable for further refining or fractional distillation into separate hydrocarbon fractions.

A further object is a process for the production of water soluble mineral products such as NPK (nitrates, phosphates, potassium) fertilizer components and sulphur compounds that can be further processed into epson salts, ammonium sulphate or comparable commercial mineral compounds.

Yet another object of the invention is to produce a highly exfoliated, porous charcoal product (coke) from coal that is substantially free of oily petroleum or bitumens as well as being low in inorganic mineral content, especially sulphur and minerals that can contribute to pollution complications as in burning boiler fuel.

It is also an object of this invention to produce a high carbon fuel that can be pulverized with ease and which is water wettable and therefore suitable for the formation of a pipeline transportable water slurry. Another object of the invention is to recover water, coke and gas from lignites otherwise deemed valueless or considered to be a strip mine disposal problem. Another object of the invention is to so process the carbonaceous material that residual unburnable inorganics such as pyrites may be gravimetrically separated and removed.

From the beginning, the various schemes for converting coal have evolved along the consistent pattern of chemical conversion of carbon, water and air. In the absence of some catalyst as yet to be discovered, the thermodynamics of these reactions utilize a substantial portion of the feedstock carbon (coal) and require what is generally considered industrially to be very high pressure and temperatures.

The chemical reactions of these various processes follow the pathway of carbon oxidation to $CO_2$ and a subsequent high energy reduction to CO. Carbon monoxide, water (steam), and atmospheric and entrained air provide the raw feedstock for further chemical conversion to a host of precusors such as methane and ammonia. Catalytic and hydrogen source reactants further convert the source materials to higher grade synthetic carbon-base fuels and related products.

I have succeeded in substantially altering this traditional method of converting coal to other usable forms. The internal reactions are chemically complex and not yet fully understood, however, the physical means are relatively simple and energy-conserving.

My process preferably involves the concurrent, interrelated actions of time-temperature selection and subsequent refluxing of the evolved various, and generally abundant, volatile constituents of coal, enhancing the ultimate production of lighter fraction petroleum products, pipeline gas, inorganic minerals, water, and a near-pure carbon charcoal residue. The reaction pathway is governed by the time-temperature gradient; fractions are evolved and obtained at progressive points throughout the process.

Another object of the process is to process coal so as to yield up its various volatiles and concurrently to reflux a portion of these same materials with the residual in an unending cyclic manner, employing water, entrained air, gases and vapors evolved by the process. The resulting yield is a wide range of petrochemicals, inorganic minerals, and other hydrocarbons.

The refluxing process is also accomplished at a relatively low temperature through approximately 750° F. maximum, as already noted, and at standard atmospheric pressure. Maximum process temperatures are essentially self-regulated by the boiling points and other phase changes, contrasting strongly with all previous conversion-type processes in which temperatures up to 2000° F. and pressures up to 3000 psi are required.

IN THE DRAWING

FIGS. 5A and 5B are thermographics;

THE PROCESS OUTLINE

Figure 1:
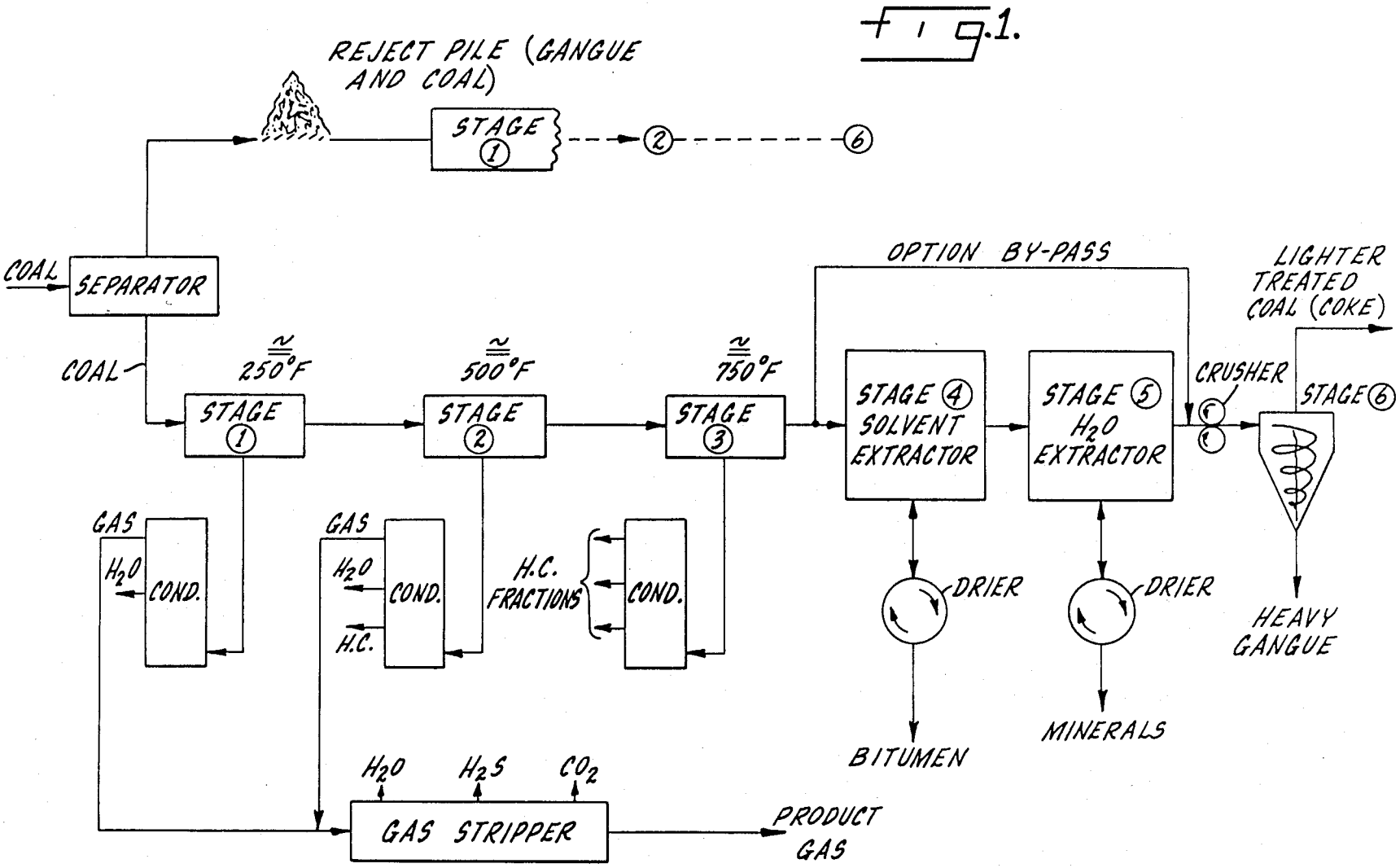
FIGS. 1, 2 and 3 are diagrams of the process steps and features under one embodiment of the invention.

Coal in general varies widely in characteristics over a range from high carbon anthracites to high bituminous lignites and the like. The basic process outlined here is applicable to most forms or ranks with end products and total economics directly dependent on the particular coal base.

Coal is first roasted at a temperature less than the pyrolytic point at or near atmospheric pressure, say about 220°–230° C. Water, gas and aqueous solutions of water soluble gases having a low vapor pressure within the coal body are rapidly vaporized. The internal vapor pressures, operating along the predominant bedding planes initiate delamination and transverse exfoliation of the major coal substrate.

The water and water solubles driven off in the initial heat treatment process are recovered as a distillate by means of a simple fluid cooled condenser. Fractional distillation may afterwards be applied to the condensate in order to fractionate or separate the water and the various aqueous solutions which include water soluble light weight petroleum products such as naphtha and benzene. Combustible fixed gases such as methane may also be collected, generally in substantial amounts.

During the distillation phase a fraction of the distillate water is refluxed back to the coal stock either to enhance the solvent stripping action or to produce a slurry, or both as will be explained.

At the end of the water stripping phase, retort temperature is increased to 350°–400° F., depending on the particular character of the coal. The temperature must not be allowed to reach the onset of pyrolytic reaction between the various free and entrained coal constituents, i.e. carbon, bitumens and inorganic minerals. It is important also to consider in this connection that some minerals, such as the oxides of aluminum, magnesium and even heavy metals in scant supply can serve as powerful catalytic agents and promote vigorous reactions between organic and inorganic substances when critical temperatures are reached, likely to result in products dangerous to health.

At the higher temperature, or petroleum fraction phase, a variety of bitumens can be recovered either separately or collectively as distillate, sweet oils and heavier tar residue. During this phase a considerable amount of additional fixed gas, predominately methane, is evolved and can be collected as a tail product of the distillation.

The amount of methane recovered depends on the character of the coal involved but in almost every case is substantial, comprising in the order of 6% to 8% by weight of the original coal, equal on an energy basis to approximately 2.5 million BTU per ton.

Following the higher temperature phase (up to 400° F.) the now highly exfoliated coal residue is treated in boiling solvent. A wide range of solvents are applicable varying in reaction time and extraction efficiency. Water may be the principal solvent used because in nearly all cases it is completely effective in removing soluble inorganic minerals. However, some ranks of coal have a high masking makeup of waxes and tars which can be effectively extracted with an organic solvent prior to the water extraction phase, especially true of coal ranks combined with oil shale impurities containing kerogen.

I have found the chlorinated solvents such as trichloroethylene or perchloroethylene to be especially effective, boiling at 250° to 350° F., in stripping the petroleum oils from the coal, resulting in more porosity and rendering the partially stripped coal hygroscopic; also, soluble inorganic minerals are further exposed. Because of their low boiling point and low latent heat of vaporization, these solvents are especially easy to recover and recycle in a completely closed, environmentally neutral system. Chlorofluoromethanes of the "Freon" type are also suitable as solvents.

Product bitumens removed by solvent extraction are easily separated by low energy distillation from the solvent solution.

Petroleum based solvents such as gasoline or diesel oil can be used as coal bitumen solvents. However, their solvent power is very low by comparison to perchloroethylene for example, and furthermore, the extracted mineral content displays a high affinity for petroleum based solvents which are therefore difficult to remove.

As can be seen from the above, the process involves the selective and sequential separation of various products from coal. Water, combustible gas and aqueous mineral solutions are selectively removed and delamination is initiated at what I term the water phase of stripping. Further selective processing removes and recovers volatile petroleum products and fixed gases and results in further delamination and exfoliation of the coal substrate.

A further selective step, following solvent extraction, involves the boiling of the coke residue in water, the object being to extract water soluble inorganic minerals that have been exposed or uncovered by the selective removal of water, gases and bituminous occlusions or entrainments. These minerals include potassium salts, nitrides and phosphates, and sulfur is also carried away in the outgas and hot water leach.

Many coals are characterized by highly soluble phosphate content, an average being about 20 pounds per ton of coal. These phosphates are usable as fertilizer components and represent a substantial extra economic return in addition to the petroleum products. Some coals contain water soluble nitrogen fertilizer fractions which further add to the overall economic coal product yield. In this respect it should be noted that the selective removal of soluble, unreacted nitrogen compounds not only results in a valuable by-product but at the same time prevents their entry into the petrochemical train.

Nitrogen compounds thus removed from coke result in a cleaner burning boiler fuel (coke), lower $NO_x$ stack emissions, less associated atmospheric pollution and certainly less costly pollution control measures.

In like manner the sulphur content of processed coke is substantially reduced by means of the selective non-pyrolyzing process. The resulting coke is more sulphur free. Pollution control costs and environmental hazards are substantially reduced. Very high sulphur coals warrant further processing in order to further extract entrained pyrites. In any event, a wide variety of coals can be used as boiler fuel sources with substantially reduced pollution control expense.

Entrained pyrites and other insoluble minerals are readily separated from processed coke by simple gravimetric means. Such treatment, at little precombustion expense, is effective in substantially reducing sulfur content as well as potential ash forming residue.

PROCESS FLOW CHART

Referring to FIG. 1, mine run coal which may be mixed with rocks, is subjected to a gravity separation (generally at the mine site) so that the lighter coal may be directed along one process path while the heavier rocks (along with unseparated coal) are collected separately, say in a reject pile as shown. However, actual experience reveals the reject pile usually contains appreciable coal values, sufficiently so that the material in the reject pile can also be processed economically be similar means. Indeed, concepts of the present invention are traceable to my experience with reject piles deemed by the coal mine operator heretofore to be either waste or uneconomical fallout. The customary reject pile originates due to a marginal seam in the first place, or as the result of mining to the very edge of the seam.

The coal concentrate emerging from the gravity separation, as it may be termed, is subjected to several stages of selective, incremental temperature increases, the increment or intensity varying with the coal rank, as there is an incredible variety depending upon coal geography as can be imagined.

This staging of the coal concentrate, and the optional solvent extraction phase, if employed, is preparatory to an ultimate separation, in accordance with the present invention, between a light weight coke and a heavy gangue of unburnable rock material not separated in the initial gravity separation and which is bound to be entrained. As a consequence, the coke fraction is highly purified and sufficiently hygroscopic that it can be easily slurried with water for pipeline transmission; or the pure coke product may be briquetted or pelletized. Light petroleum fractions derived from the process may be used as a pellet binder and/or BTU enhancer.

At stage one, FIG. 1, the coal concentrate is heated to a temperature in the neighborhood of 250° F., above the boiling point of water and hence sufficient to remove entrained moisture plus low vapor pressure, water soluble hydrocarbon gases such as methane. The water vapor, of which there is a great deal, is preferably condensed and recovered for use on the spot. Specifically the condensed water may be used to slurry the final coke product or it may be used in the hot water leach stage for recovering water soluble minerals as will be explained. Its latent heat of condensation may be recovered in accordance with my U.S. Pat. No. 4,294,664.

The process is continuous and a screw conveyor may be employed to move the coal concentrate from one stage to the next. At the next stage the temperature is high enough (say 500° F.) to drive out additional hydrocarbon gases together with the last of any deeply entrained moisture and low vapor pressure, water soluble gases. Again the water may be condensed for utilization at the site and in particular the process-derived water may be refluxed to aid in mineral separation or to enhance, by conversion, gas and light petroleum yields. The low vapor pressure, water soluble gases such as methane may be recovered and used as a fuel. The higher molecular weight gases may also be condensed as hydrocarbon liquids (an oil) and can be separated (decantation) from the condensed water. The condensate oil at this stage will vary according to the coal rank but would generally be classified as a light to middle oil having a boiling point of 320°–468° F.

The third stage (all stages are structured as a roaster or oven) is operating at the highest temperature but not more than about 750° F. since the present process is not one of burning coal, nor one of roasting it in an oxygen-free atmosphere as in destructive distillation. In other words, the present process does not result in pyrolytic conversions. At the third stage of elevated temperature treatment the last of the hydrocarbon fraction is driven off and condensed as a heavy oil; the coal concentrate at the end of the stage is porous, delaminated and extremely fragile.

The next two stages are optional depending upon the quality of the coal product emerging from the third stage. These options are introduced so the process in general is applicable over the range from low grade lignite to high BTU anthracite. If the third stage product is essentially oil-free and hence hydroscopic, the strong solvent extraction stage may be eliminated or bypassed. Also, if the coal is essentially free of water soluble minerals the water solvent extraction stage may be eliminated or bypassed.

In case both options are unnecessary, the coal product from stage three is a true coke free of pollutants and if necessary may be crushed to a finely divided state suitable for water slurrying. The crushed coke is then delivered to a cyclone (gravity) separator (the last gravity separation stage) for final purification in the sense of removing the last of the heavy, unburnable rocklike content which may remain entrained. Here, at stage six, the cyclone separator discharges an unburnable gangue or overburden (insoluble rock fines and pyrites if present) and the lighter underburden which is the pure coke product of the present invention.

The result of stage three is to induce removal of the last of the volatile hydrocarbons (H.C.), including high boiling point hydrocarbon liquids. This third stage removal process results in internal delamination and porosity of the coke so that it is frangible, easily crushed and floatable in water. Nonetheless, some coke at this stage may retain kerogen (if the coal is from oil shale country) tar or wax, collectively designated bitumen herein. This bitumen content may be removed at stage four by boiling the stage three product in a strong organic solvent such as perchloroethylene or perchloroetholane at say 350° F., which readily penetrates the porous coke material. This treatment by a strong solvent is similar to and may indeed follow the process described in my U.S. Pat. No. 4,130,474. The solvent may be recovered and recirculated as described hereinafter in connection with FIG. 3.

It may be mentioned that removal of bitumen and other organics at stage four renders the coke product extremely hygroscopic, if it is not already hygroscopic after stage three.

If there is a water soluble mineral content in the coal, worth recovering, it may be recovered at stage five by the solvent action of hot, it not boiling, water. In this class of water soluble materials are nitrates, phosphates and potassium salts having fertilizer value.

Batch Process

Figure 2:
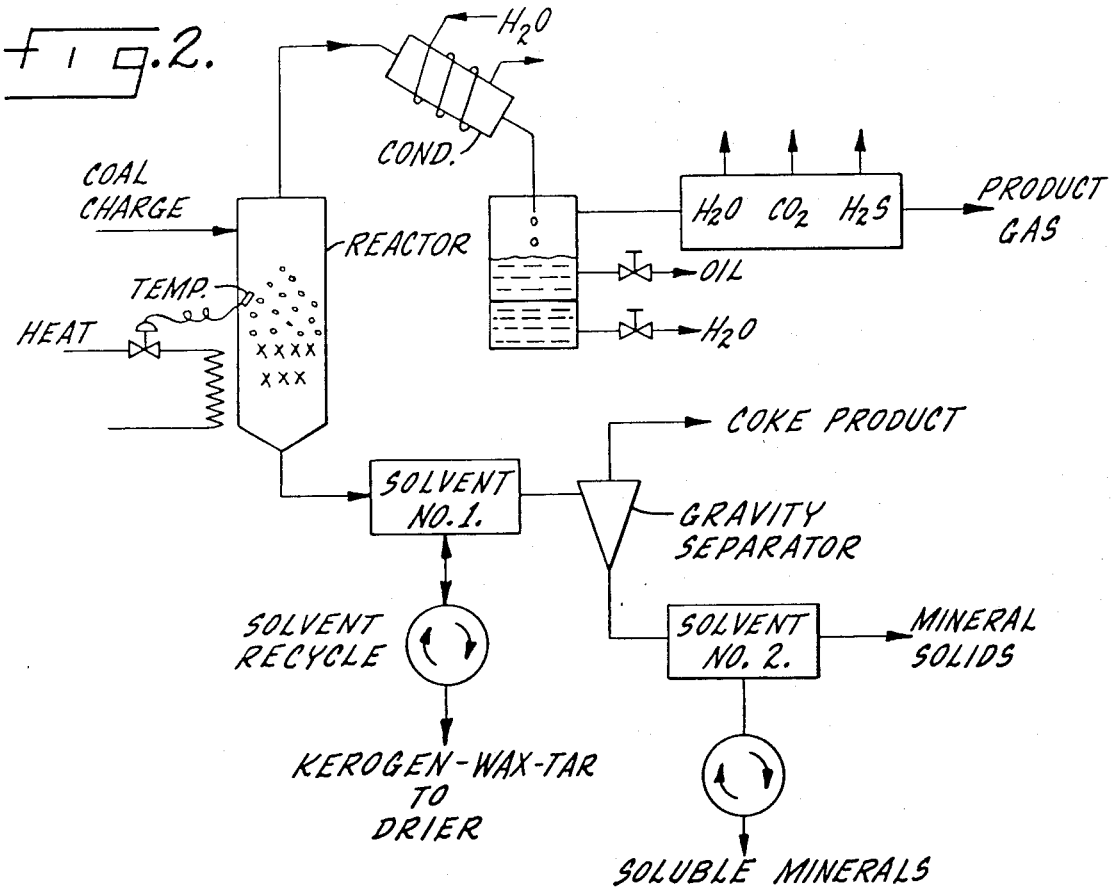

The process may be batch as well, FIG. 2, especially applicable to small scale operations. Temperature staging (three stages as in FIG. 1) is accomplished in a single reaction vessel, stripping water, low vapor pressure water soluble fixed hydrocarbon gases, high vapor pressure hydrocarbon gases and low boiling point hydrocarbon liquids. These stripped, vaporized compounds are passed from the vapor space of the reactor or cooker vessel to a water-cooled condenser where the condensable gases are condensed; latent heat of condensation is recovered and utilized as a source of hot water if nothing else.

The condensed liquid (oil and water) is separated by decantation and any gases remaining are stripped (cleansed that is) to leave a relatively pure burnable methane or related hydrocarbon gas.

The coal concentrate (coke) remaining in the reactor vessel is delivered to a solvent extraction chamber where it is boiled in a strong solvent for removing any appreciable bitumen content such as waxes, tars and oils not removed at the reactor; also kerogen if there is any oil shale mixed with the coal. The solution containing the stripped bitumen is treated to remove, recover and recycle any entrained solvent. Coke thus deprived of bitumen, if any, is delivered to a cyclone (gravity) separator where the light (coke) overburden may be treated with hot water to dissolve any water soluble fertilizer content (or other water soluble mineral value) worthy of separation. The principle of floatation separation may also be used. Prior to the hot water leach the coke may be crushed to a fine state if necessary. The hot water derived at the condenser may be used in the water leach. The heavy rock underburden may be used as a fill.

Figure 3:
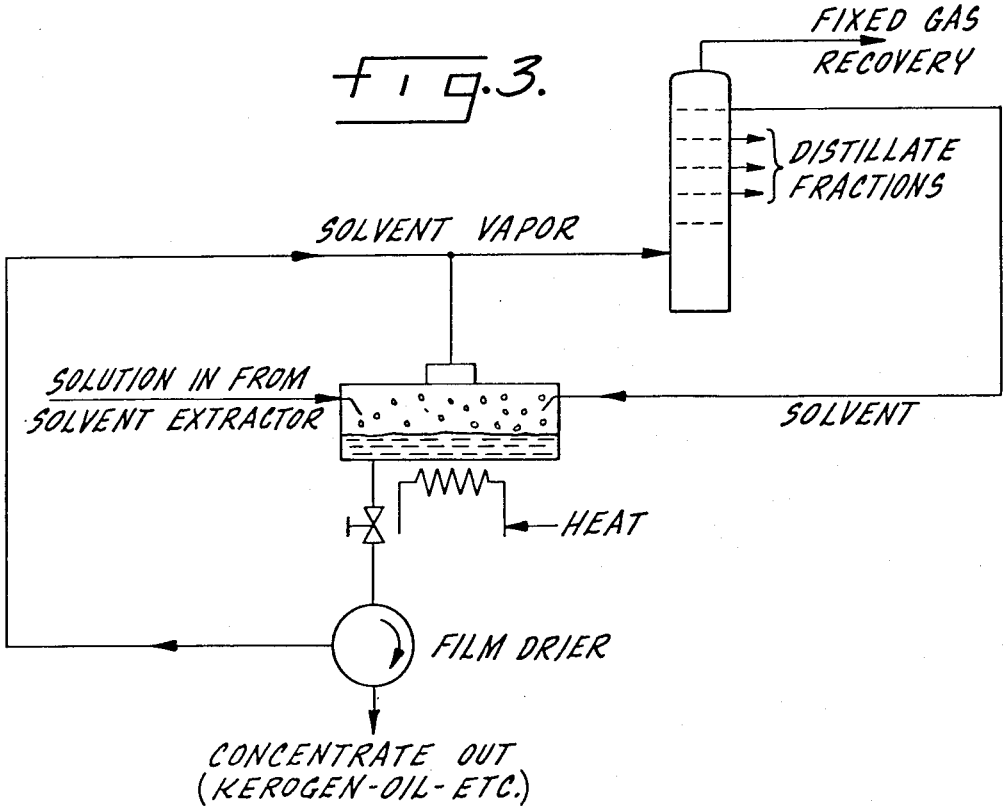

A system for recovering solvent is shown in FIG. 3. The solution containing the dissolved bitumen is passed to a still where the solution is boiled.

The solvent vapor is passed to and stripped at a fractionating column; here any entrained bitumen fraction is recovered as well as the stripped solvent which is returned to the still. The desired product, the solute, is drained to a dryer where any entrained solvent is removed and delivered to the fractionating column; the concentrate is the desired product.

Figure 4:
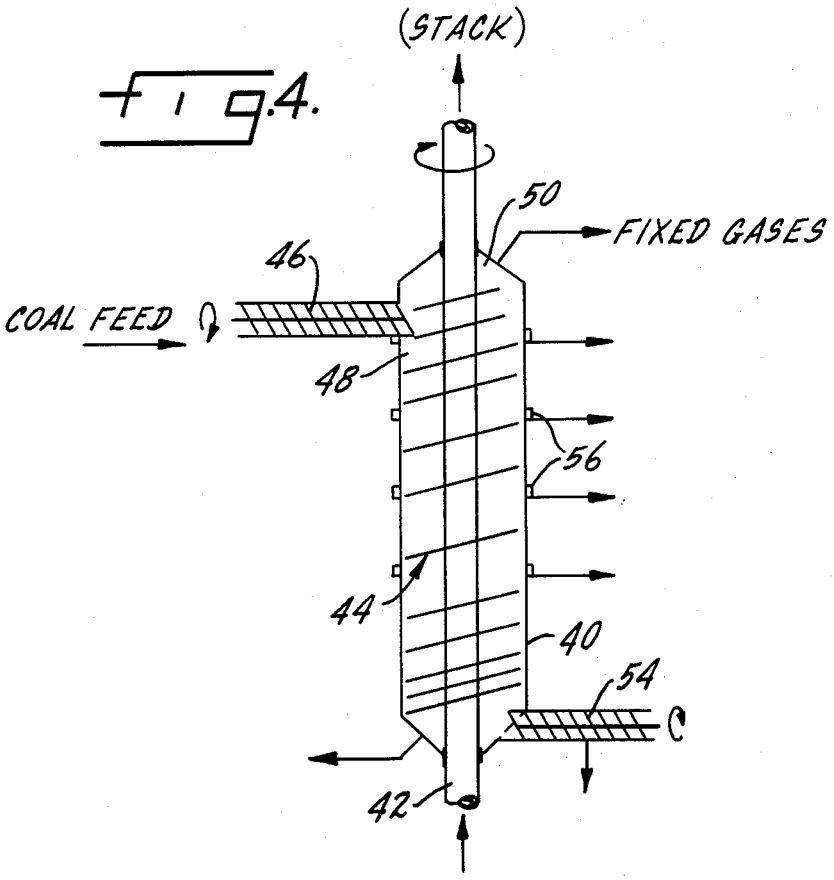
FIG. 4 is a schematic of a retort system.

The coal to be converted may be, and preferably is, processed in a refluxing retort, FIG. 4. Petroleum products, gases and other condensates are recovered at progressive points within the reactor. Charcoal, heavy petroleum products, and residual sludge are discharged at the bottom. Preferably one employs the retort configuration shown in FIG. 4 as comprising a vertical column 40 heated by a central heat exchange flue 42 which doubles as a drive shaft for a feed screw 44.

The preferred down-fed column retort 40 is well adapted to modular expansion. The mine-run coal is fed by a screw 46 into the burden chamber 48 of the retort at a point below the light fraction recovery point, near the top or head of the retort. Fixed gases are recovered at the retort head 50. The screw 46 also serves as a gas lock or check.

Coal is fed downward through the retort by the rotating screw 44 and the coke product ("char") is discharged by means of a screw 54 at the retort bottom. The downward moving coal is mixed in contact with and heated by the central heat-exchange flue 42. The product gases and vapors may be reheated and introduced directly into the burden chamber of the retort in order to provide additional reaction heat and to serve as reflux reactants in the role of "hydrogendonor." The upward movement of these gases in the burden chamber also elevates and separates the downward moving coal bed and improves heat distribution. The stack gas may be used to preheat the input coal.

The various hydrocarbon (petroleum) fractions, both liquid and vapor, are removed by and at collector rings as 56. The gases representing petroleum fractions will be condensed and may subsequently be mixed (or not) with the recovered hydrocarbon liquids. At the same time, inside the retort, these same (but uncollected) fractions will be refluxing.

Coal proceeding downward through the reaction column (or an inclined kiln which may be used equally well) is subjected to sequential and varying reaction segments or zones. The residence times and temperatures in these zones are preferably keyed (complemented) to the system thermodynamics as will be explained. The thermodynamics of the process will, of course, be related to the properties of the particular coal being processed. This can be visualized by comparing two extremes, namely, a high quality anthracite coal versus a low quality peat. The process exhibits both exothermic and endothermic reactions throughout; zone reaction time and temperature are adjusted accordingly.

A typical thermospectrum in the vapor space at the head of the retort is shown in FIG. 5A. In the initial or low temperature phase the head space is "cold" and only gradually acquires sensible heat. Subsequently, mostly water is evolved and evaporated, constituting the first phase change, and due to the latent heat of vaporization of the water the reaction is strongly endothermic. A sustained residence time and high BTU input would be required for the coal burden at this point in the reactor because of the endothermic phase change when the entrained water or moisture content is being evaporated (consumes 540 calories per gram).

Subsequent processing, FIG. 5A, when substantially all the water content has been removed, involves both endothermic and exothermic reactions which can be controlled by residence time and temperature within the various zones in the burden chamber 48. Thus the thermospectrum of FIG. 5A exhibits an exothermic reaction phase wherein some evolved gases and vapors are converted by reflux action to lower BTU value products thus releasing a substantial amount of heat energy.

Following this (still looking at FIG. 5A) some petroleum products are vaporized and converted to higher BTU value products. These reactions are essentially endothermic and as in the water phase, require a net thermal input. There are numerous phase change reactions through the overall process. They depend to a large extent on the properties of the coal being processed, as already noted.

The rotating screw or auger baffle fastened to the flue shaft 42 provides additional heat exchange and promotes a mild stirring mixing motion to the coal feed path.

Sludge, comprising fines and tars, is drawn off near the retort bottom. Charcoal (coke) and any associated tarlike petroleum products are extracted by the screw 54 above the sludge drain point for further separation and processing.

Process heat, derived from the heat exchange flue and reheated reflux gas, may be supplied in part by means of external combustion of a portion of the product fuel: raw gas, oil or charcoal, FIG. 4. The heat requirement is a balance of the system thermodynamics.

Sensible heat, latent heat of vaporization, and exothermic reflux reaction heat comprise the net balance. In general, less than five percent of the total coal energy is required to sustain the reaction, but again this is dependent upon the specific quality of the coal.

Overhead gases may be passed through a simple condenser which extracts carryover water vapor and light residual petroleum fractions. Fixed gases fed from the condenser are further processed by means of conventional gas stripping devices such as soda and lime.

High petroleum vapors, as noted, are recovered with the product charcoal, near the retort bottom by the discharge screw auger (or other discharge means) and as a consequence of bottom distillation a portion of the heavy vapors rise along the central heat exchange flue to be cooled by the outer retort wall, descending to the hotter lower portions in a reflux cycle. A multiplicity of continuous reflux cycles are thus established. Internal refluxing phenomenon is responsible for a high efficiency in stripping the last or bottom-most petroleum fractions from the coal, as the best solvent for any substance is that substance itself.

The heavy petroleum vapors thus collected by the bottom distillation phenomenon are quite mobile, and there is little readsorption to the hot discharge charcoal. Gas exit ports may be provided along the discharge channel, where these mobile vapors are separated and collected. These vapors are unusual in that they tend to form a gaseous, colloidal-like suspension and are difficult to otherwise condense.

Vapor stripping is achieved by means of a series of conventional traps which may include a defogger, water bath and a condenser.

Process heat required for conversion, as noted, is supplied by means of external combustion and heat exchange. In most cases, a relatively small portion of stripped or reflux gas from the retort head is required. Excess product heavy oils or charcoal can be used in rare cases where there is little excess gas. Nonetheless, it can be expected that only a small portion of product fuel is required to sustain the reaction.

Depending upon the coal characteristic, the petroleum distillates, which in most cases are greater than one-half barrel per ton, contain as much as thirty percent gasoline fractions. The heavy residual petroleum fractions can be processed in a conventional manner. Product gas (mostly methane) and water will serve as hydrogen donors in upgrading these fractions, as mentioned above.

Coal-entrained, water soluble inorganic minerals, stripped from the coal and cyclically refluxed by internal percolating means throughout the lowest (hot) region of the retort, will be discharged along with other bottom fractions. These minerals can be recovered by water leaching as already explained. The resultant water solute contains substantial amounts of minerals that would otherwise become undesirable stack emissions constituting environmental penalties: sulfur, ash, slag and $NO_x$.

The water soluble minerals recoverable from the bottom solute are rich in fertilizer base elements, notably nitrogen, phosphate, and potash (N, P, K). In some instances, the fertilizer dollar value may be greater than that of the feed coal as mined, again depending on the grade of coal.

Product coke is highly exfoliated and frangible. In cases involving high concentrations of water insoluble minerals, further processing of the product charcoal by means of air or liquid gravimetric separation may be accomplished by conventional means general at a substantive economic advantage.

Heavy bottom coal bitumens have been found to be a rich petrochemical and pharmaceutical raw feedstock, pyridines being a good example.

FIG. 5A is derived from conditions of constant thermal input. Temperature measurements were made at the retort head where the various evolved gases and light petroleum fractions are carried over, and as already noted the ascending and descending temperature excursions are indicative of the endothermic-exothermic nature of the reactions and the dwell time or heat energy exchange. Actual heat transfer in terms of BTU, or equivalent, is a product of temperature, specific heat, latent heat and residence time. This is shown more clearly in FIG. 5B which is representative of the temperature of the coal body moving through the retort throughout a wider temperature range.

The thermal spectrum is masked to some extent by the relatively large thermal mass of the coal being processed. However, the need for distributed, variable heat energy exchange is clearly indicated. The zonal heat exchanges vary with the particular coal or other substance under process and are compounded by the reflux reactions taking place. The reactions are both self-generated and sustained within the reactor by way of its structure and heat energy control as well as by reflux paths external to the retort.

Figure 6:
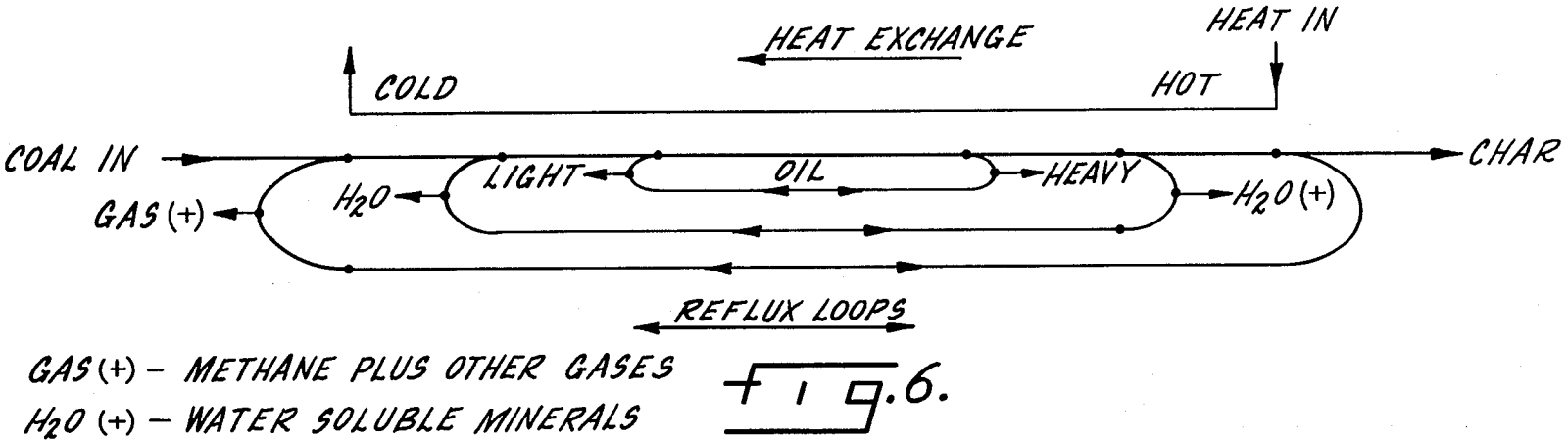
FIG. 6 is a diagram of certain process loops.

FIG. 6 is a diagram of the principal reflux circuits whereby various coal constituents are recovered. While a thermal gradient from the hot to cold end of the retort is indicated, this view does not necessarily represent the actual dwell times and thermal exchange throughout the process retort.

Figure 8:
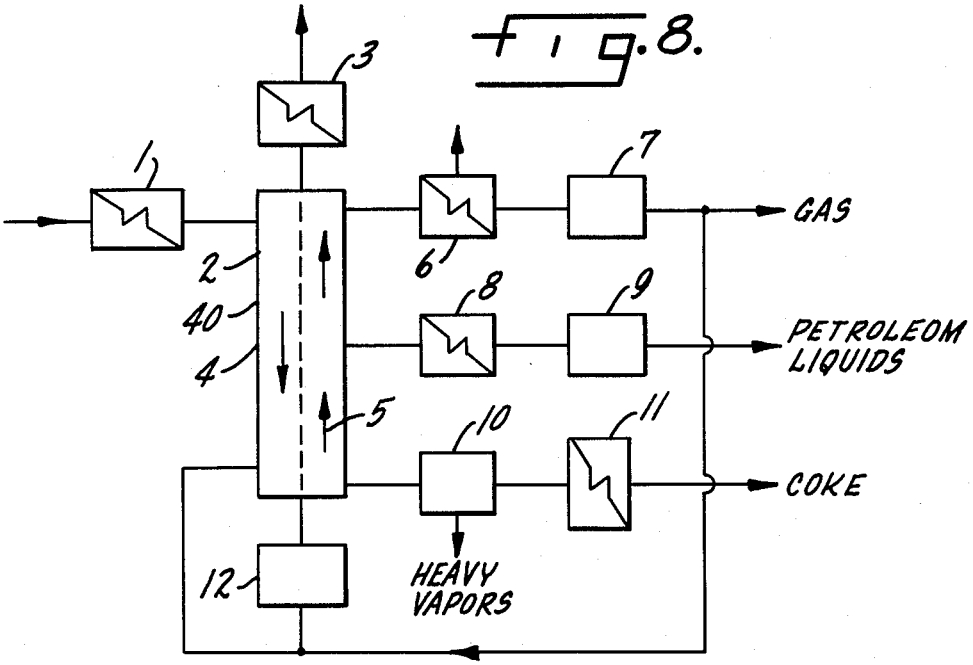
FIGS. 7 and 8 are diagrams depicting the preferred process.
Figure 7:
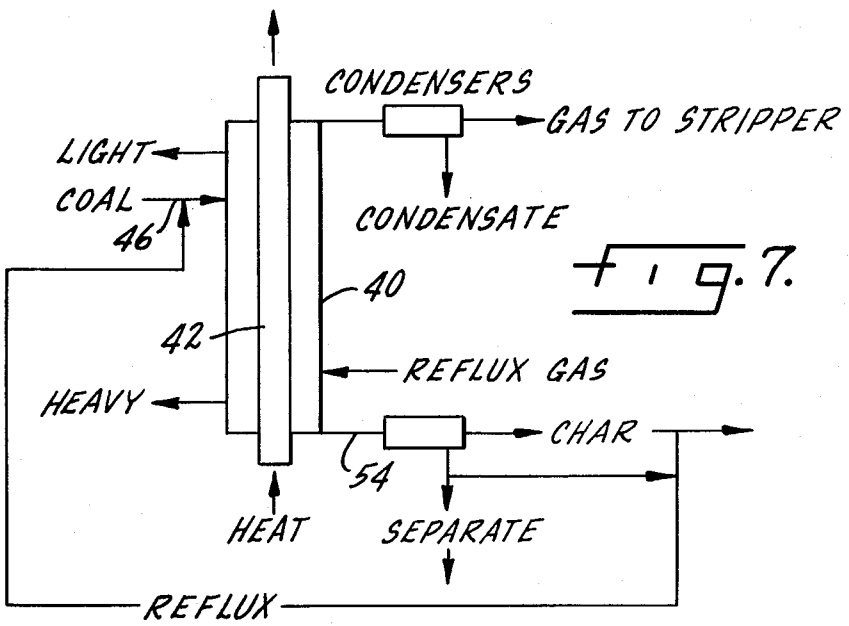

The retort and external connections are shown in simplified schematic form in FIG. 7 and with more elaboration in FIG. 8. Reaction heat is supplied by way of the heat exchange flue and the external combustion of a portion of the product fuel, either gas or petroleum. Gases and vapors are condensed and separated by way of an external condenser. Petroleum condensates (both light and heavy) are collected along the outer, cooler, retort wall either collectively or separately. Heavy petroleum vapors and liquids (bottom distillation) are separated by way of a discharge exit (54) and separator so that the product residue (coke) is discharged free of heavy condensates.

According to FIG. 8:

1. Heat receiver (Coal preheater).
2. Process retort (roaster).
3. Heat Source (Burner stack emissions).
4. Coal down feed path.
5. Ascending reflux petroleum, vapors and gas.
6. Heat receiver (condenser).
7. Gas Stripper.
8. Petroleum condenser (heat receiver).
9. Petroleum separator.
10. Coke-Vapor separator.
11. Heat source-Coke cooler.
12. Burner, heat source.

Figure 9A:
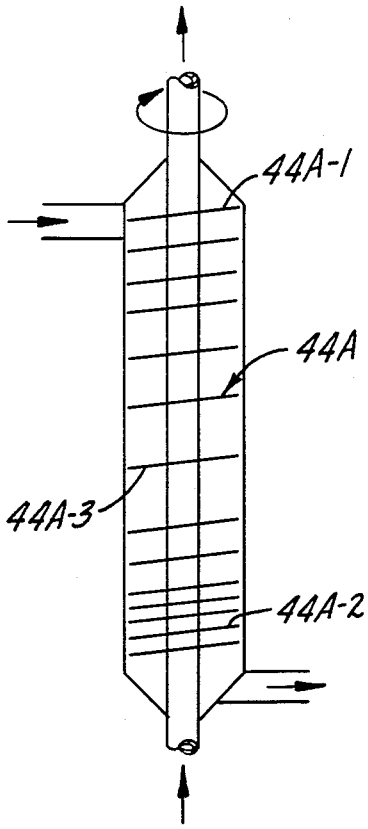
FIGS. 9A, 9B and 9C show additional embodiments.
Figure 9B:
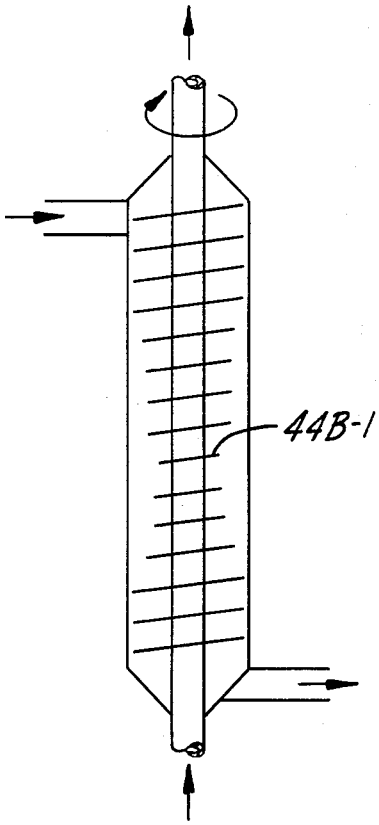
Figure 9C:
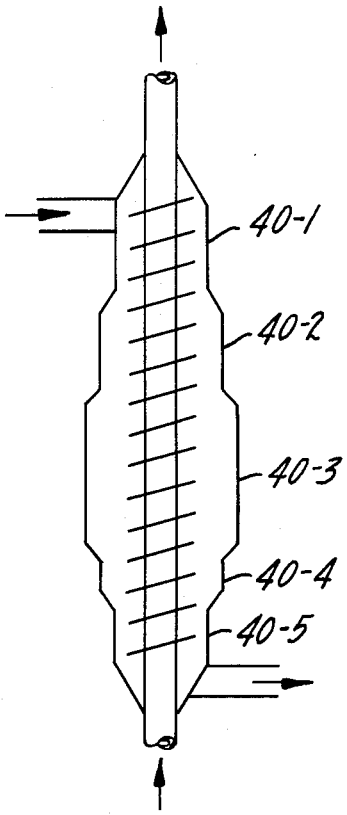

FIGS. 9A, 9B and 9C depict different forms of conveyor apparatus for the movement of coal through the retort whereby the coal is subjected to different dwell times in the aforesaid thermal control zones. A preferred embodiment is shown in FIG. 9A wherein the downfeed screw or auger 44A is constructed with a variable, progressively staged pitch angle for varying the zonal throughput rate.

For example, as the coal, presumably at or near ambient temperature, is introduced into the retort, an infusion of sensible heat is exchanged between the incoming coal and the discharging relatively hot overhead gases and vapors. This comprises a mere warming and roasting zone. Further, as with most coals and especially lignites containing a great deal of moisture, a considerable amount of supplied latent or phase change heat exchange is required. The delayed dwell time is achieved by means of the feed auger 44A whereby the auger screw pitch throughout the zone is shallow or low pitch 44A-1 and the screw feedthrough correspondingly slow. The feed rate is even slower at the bottom of the retort where final conversion to a relatively pure coke takes place over a protracted period, necessitating an even finer pitch 44A-2.

Different coals require substantial variations in this feed rate, achieved by rotating the screw at a faster or slower rate or even by way of structurally tailoring the feed auger screw pitch to the particular coal being processed, or both.

Zones of low thermal input, such as gas phases, are established by way of a deep or fast feed auger pitch section 44A-3 that moves coal through the zone more rapidly.

FIG. 9B shows an alternative means of maintaining a complemental zonal thermal control (complemental to the BTU coal conversion requirement) wherein the feed rate is structurally adjusted by way of a feed auger having a spiral baffle of progressively varying or different radii relative to the internal retort diameter. A fast throughput zone 44B-1 is provided, for example, by a screw convolute of relatively small radius, allowing a substantial free spill-over throughout the zone of otherwise constant length and thermal exchange.

Yet another means of thermal control is shown in FIG. 9C whereby zonal control is achieved by way of retort configuration of zonal variations in bulk diameter and length, denoted 40-1, 40-2, 40-3, 40-4 and 40-5. A constant diameter and pitch feed auger is generally preferred in such a configuration.

The system in the instance of a high quality coal is self-sustaining in terms of energy requirements (thermal input only) consuming a relatively small portion of its own self-generated fuel (gas and oil) as an energy source when producing a high quality coke. This modest energy requirement is reduced even further by utilizing the heat recovery means disclosed in my U.S. Pat. No. 4,294,664 relative to sensible heat recovery, latent heat recovery, or both.

Figure 10:
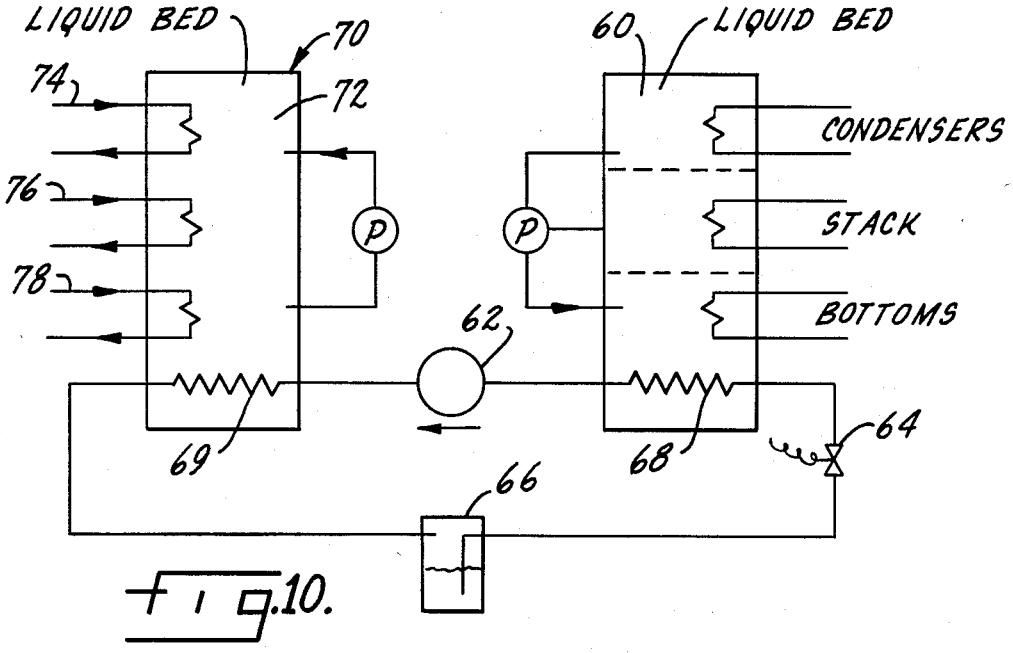
FIG. 10 is a schematic in which a heat recovery system is imposed on the process.

An elaborate heat recovery plan is illustrated in FIG. 10 wherein a basic mechanical compression-evaporation refrigeration phase is coupled to the coal conversion unit. A closed body of liquid (e.g. water) identified by reference character 60 (which may be water jackets, for example) receives sensible heat from the stack, sensible heat from the bottom products of the retort and latent heat released when the liquids (e.g. water and petroleum gas fractions) are condensed.

The heat thus collected, both sensible and latent, results in the body of water 60 being raised in temperature and this heat is exchanged to the refrigeration fluid being circulated by the compressor 62. The compressor 62 is part of a closed refrigeration loop that includes the usual expansion valve 64, the receiver 66, the evaporator 68 and the condenser 69. The evaporator receives heat from the body of water 60. At the condenser 69 the heat thus recovered and transferred via the evaporator 68 to the refrigeration fluid is released to the coal conversion system 70 and again water jackets (collectively 72) may be employed for this purpose so that the entrant coal may be preheated at 74, the retort itself may be jacketed at 76 at a strategic point and at 78 heat may be added elsewhere.

It should also be noted in conclusion, there is combined refluxing, both self-induced internal refluxing and external refluxing of all or nearly all of the reaction products including water, gas, oils, and coke residue. The reintroduction of stripped product gas upgrades the entire hydrocarbon product spectrum. Refluxing a portion of the product coke extends an effective residence time in the interest of a more complete reaction as well as a heat exchange means between cold, raw input stock and hot, exit product coke as can be appreciated from FIG. 7. The reintroduction of bottom distillate water solutions (see FIG. 7) results in a near complete conversion of the water (a hydrogen donor) to methane and some $CO_2$.

I claim:

1. A method of converting coal to a porous easily crushed coke, which may be slurried with water for pipeline transport, by roasting the coal in selective increasing thermal stages below its combustion temperature in a refluxing retort thereby substantially to avoid pollution and thermal reaction products inimical to health and comprising the following process steps all of which are performed inside the retort, commencing with charging the coal into the retort near the top thereof where it is cooler and culminating in the coke product being withdrawn from the bottom of the retort where it is hotter:

A. heating the coal in a refluxing retort to vaporize to a gas substantially all the water and drive off substantially all the low vapor pressure hydrocarbon gases and higher vapor pressure hydrocarbon gases which may be present; the heat in-put being near the bottom of the retort and said gas being recovered near the top of the retort;

B. heating the coal resulting from step A at a higher temperature stage in said refluxing retort to volatilize hydrocarbon liquids which are recovered at one or more intermediate points along the length of the retort, causing delamination and porosity within the coal and resulting in a coke product recovered at the bottom of the retort; and C. refluxing back to the retort at a point considerably below the point where the coal is introduced at least part of the hydrocarbon gases of step A serving as hydrogen donors to the process, the movement of the reflux being counter to the movement of coal thus aiding in separating the downward moving coal.

2. A process according to claim 1 including the additional step of:

subjecting the porous coke from step B to a separation step to remove bitumens resulting in a substantially hygroscopic coke.

3. A process according to claim 2 in which water from step A is returned to the process to slurry the coke or to leach the coke.

4. A process according to claim 1 in which the coke from step B is subjected to solvent extraction to remove bitumens or oily material.

5. A process according to claim 4 in which the coke following solvent extraction is treated to remove unburnables.

6. A process according to claim 1 in which the coal is fed through the retort by a centered downfeed screw, and in which a shaft inside the retort concentric with the screw is employed as a flue for thermal input to the coal being processed in the retort.

7. A process according to claim 1 in which the coal is fed through the retort at a variable rate depending upon whether the process stage is exothermic or endothermic inside the retort.

* * * * *